United States Patent [19]

Østergaard

[11] Patent Number: 4,724,573

[45] Date of Patent: Feb. 16, 1988

[54] MACHINE FOR CLEANING CARPETS

[75] Inventor: Karsten Z. Østergaard, Hadsund, Denmark

[73] Assignee: Knud E. Westergaard, Hadsund, Denmark

[21] Appl. No.: 2,830

[22] Filed: Jan. 13, 1987

[30] Foreign Application Priority Data

Jan. 14, 1986 [DK] Denmark ..... 163/86

[51] Int. Cl.[4] ..... A47L 11/34

[52] U.S. Cl. ..... 15/321; 15/353

[58] Field of Search ..... 15/321, 353, 320

[56] References Cited

U.S. PATENT DOCUMENTS

| | | | |
|---|---|---|---|
| 3,056,994 | 10/1962 | Noble | 15/321 |
| 3,101,505 | 8/1963 | Belicka et al. | 15/320 |
| 3,550,181 | 12/1970 | Dolan et al. | 15/320 |
| 3,854,163 | 12/1974 | Evans | 15/321 |
| 4,216,563 | 8/1980 | Cyphert | 15/321 |

FOREIGN PATENT DOCUMENTS

| | | | |
|---|---|---|---|
| 3455200 | 6/1986 | Fed. Rep. of Germany | 15/321 |

*Primary Examiner*—Chris K. Moore
*Attorney, Agent, or Firm*—Felfe & Lynch

[57] ABSTRACT

In a carpet cleaning machine with a machine housing (1), two containers (4,5) for fresh and used cleaning liquid respectively and flexible tubing (2,3) connecting the machine housing (1) to at least one liquid ejection nozzle (not shown) and a suction mouthpiece (not shown), each of the two containers (4,5) is removably supported in a space (14) above a substantially horizontal portion (7) of said housing (1) and close to a substantially vertical partition portion (8) of said housing (1), each container preferably being supported by plugs (11) extending outwards and upwards from each side of the partition portion (8) and cooperating with sockets (12) recessed into the sides (10) of the containers adapted to face the partition portion (8). Fluid communication between the machine housing (1) and the containers (4,5) may be established by said plugs (11) being tubular and cooperating with openings (13) in the inner ends of the recessed sockets (12) and/or by means of a valve-cum-connector (not shown) in the bottom of the container cooperating with an upawrdly extending connector (15) on the base portion (7). This arrangement makes it easy to remove and replace each container (4,5) independently of the other container (4,5), and in the preferred embodiment shown makes the assembly comprising the machine housing (1) and the container (4,5) easy to handle and manoeuvre. A wheeled carriage (6) provides the requisite mobility.

8 Claims, 5 Drawing Figures

Figure 4:
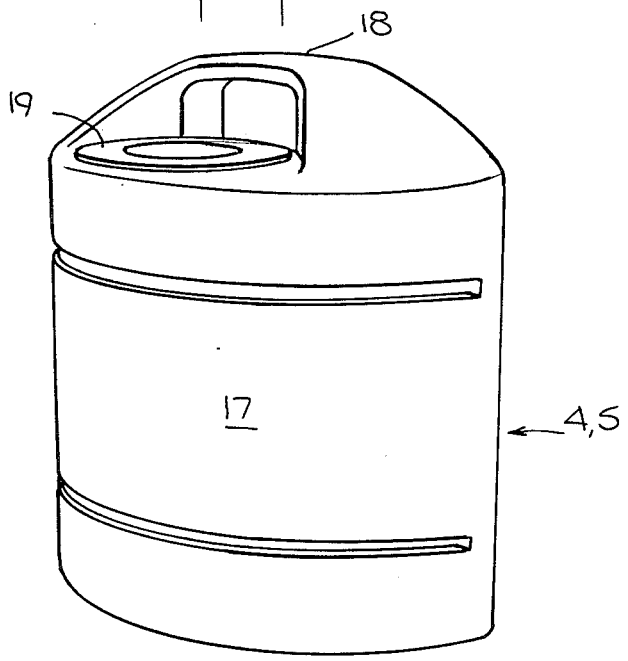

Fig. 1.
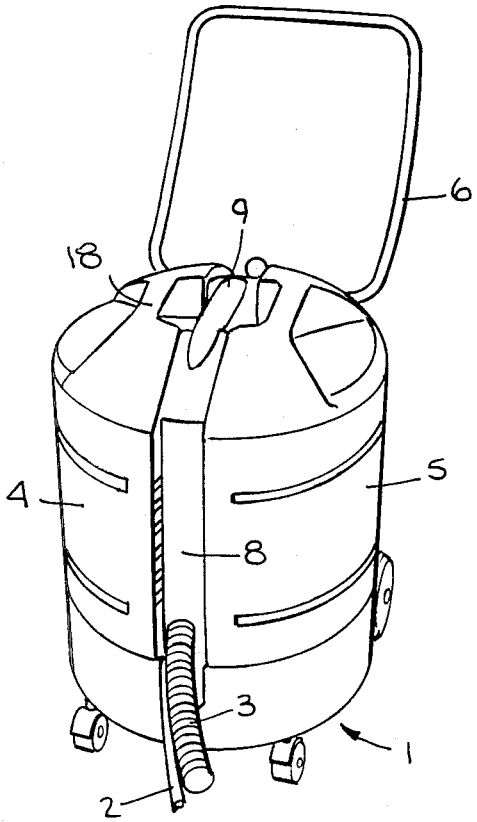
Fig. 3.
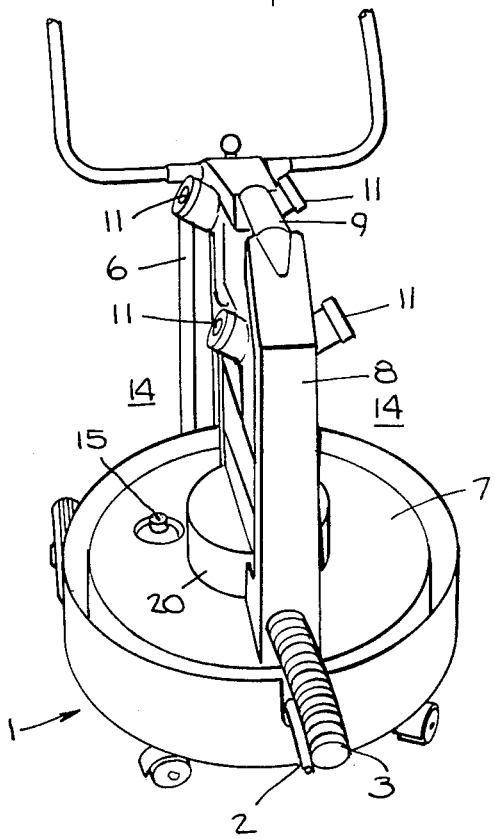
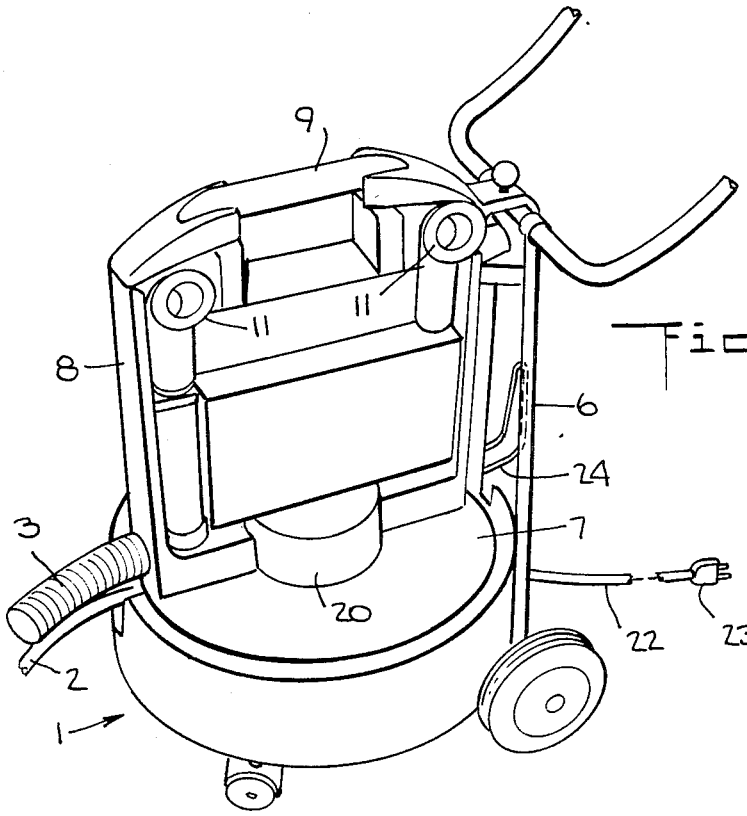
Fig. 2.

MACHINE FOR CLEANING CARPETS

A machine for cleaning carpets or the like, and a container for use with such a machine.

The present invention relates to a machine of the kind set forth in the preamble to claim 1.

In previously known machines of this kind, problems have arisen in connection with removing and replacing the containers, observing the level of liquid in them, and avoiding the operating personnel being bruised by sharp corners and/or edges on the machine or the containers.

It is the object of the present invention to provide a machine of the kind initially referred to, that does not present such inconveniences, and this object may be attained by a machine also exhibiting the features set forth in the characterizing clause of claim 1. With this arrangement, each container may easily be removed and replaced independently of the other container, and as a considerable area of the side walls of each container is exposed, i.e. not covered by any part of the machine housing, the liquid level in the containers may be visually observed, provided—of course—that they are made of suitably transparent or translucent material, such as polyethylene or polyvinyl chloride with little or no filler material.

In the embodiment set forth in claim 2, advantage may be had of the arrangement according to claim 1 with a view to avoiding shape corners and/or edges, thus reducing the risk of the operating personnel or others being bruised by violet physical contact with the machine, such as would occur during inadvertent collisions in corridors or passages with heavy pedestrian traffic. An extra advantage is the pleasing appearance of such a shape.

The embodiment set forth in claim 3 provides for easy and quick mechanical connection and disconnection of the containers with the machine housing, and the embodiment set forth in claim 4, representing a further development, provides also for the requisite fluidic connection and disconnection of the upper part of at least one of the containers with the machine housing or components placed therein, such as a suction fan aspirating a mixture of air and dirty cleaning liquid from the carpet.

The embodiment set forth in claim 5, also representing a further development of the embodiment according to claim 3, further provides for easy and quick fluidic connection and disconnection of the lower part of at least one of the containers with the machine housing or components placed therein, such as a liquid supply pump delivering cleaning liquid to at least one liquid nozzle spraying or otherwise ejecting cleaning liquid onto the carpet being cleaned.

The embodiment set forth in claim 6 provides for economical manufacture of the two containers, as they can both be produced with the same basic features, and then modified with a view to fulfilling the special functions of the two different types of container.

The present invention also relates to a first or second container for a machine according to the invention, and such a container exhibits the features set forth in the characterizing clause of claim 7. Claim 8 relates to an embodiment enabling the liquid level in the container to be observed visually from the outside.

Figure 5:
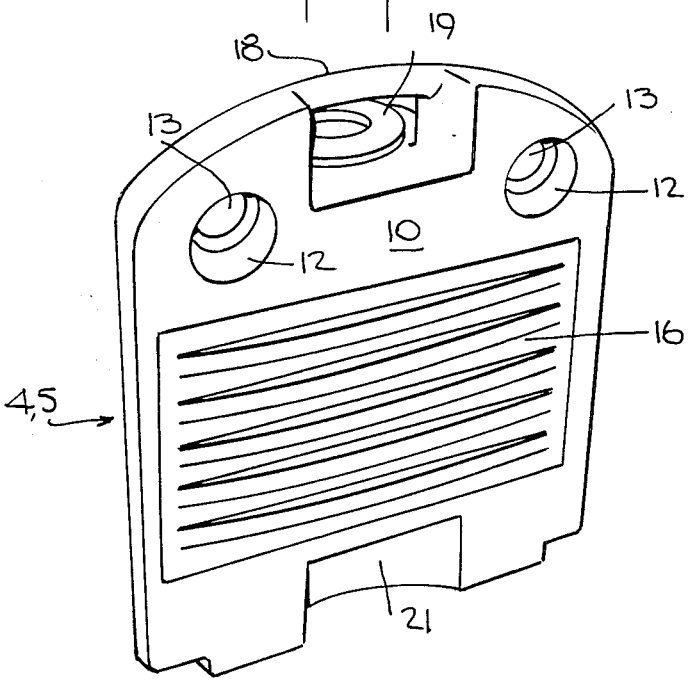

The invention will be explained in the following the reference to the attached perspective drawings, in which FIG. 1 shows the machine with the exception of the major part of the flexible tubing and the liquid nozzles and suction mouthpiece connected thereto, FIGS. 2 and 3 show the machine of FIG. 1 less its containers, as seen in two views at approximately right angles to each other, and FIGS. 4 and 5 show a container as viewed from the side facing away from and from the side facing towards the machine housing respectively.

The carpet cleaning machine shown in FIGS. 1–3 comprises the following main components:

a machine housing 1, to which are connected a flexible liquid supply tube 2 (of which only the part closest to the machine housing 1 is shown), and a flexible suction tube 3 (of which only the part closest to the machine housing 1 is shown), and further a first container 4 adapted to contain fresh cleaning liquid to be supplied to at least one liquid ejection nozzle (not shown) through a liquid supply pump (not shown) placed in the machine housing 1 and through the liquid supply tube 2, a second container 5 adapted to receive cleaning liquid containing dirt removed from the carpet or mat being cleaned, said dirty cleaning liquid being aspirated by a suction fan (not shown) placed in the machine housing 1 through a suction mouthpiece (not shown) at the other end of the flexible suction tube 3, and finally a wheeled carriage 6 adapted to carry the machine housing 1 with the other components mentioned, except the liquid supply nozzle(s) and the suction mouthpiece, normally to be held and moved manually and independently of the wheeled carriage 6.

In operation, the carpet cleaning machine shown is moved about on the carpet being cleaned by means of the wheeled carriage 6 whilst moving the liquid supply nozzle(s) and the suction mouthpiece, preferably constituting a unit, across the areas in need of cleaning, all in a way similar to the use of a normal vacuum cleaner.

The machine housing 1 consists of a horizontal base portion 7 with a partition portion 8 extending vertically upwards from a diametral area of the base portion 7 and releasably or unreleasably secured to the latter. A carrying handle 9 is placed in the upper region of the partition portion 8.

As can be seen in FIG. 1, the first and second containers 4 and 5 respectively are placed above the base portion 7 with their substantially flat walls 10 (see FIG. 5) resting against or at least very close to the partition portion 8, so that the assembly consisting of the base portion 7, the partition portion 8 and the two containers 4 and 5 assumes the shape of a circular cylinder with a vertical axis. By suitably modifying the base portion 7 and the two containers 4 and 5, the assembly may also be made to appear as a vertical cylinder with elliptical cross-section. Whether the shape is circular-cylindrical or elliptic-cylindrical, the rounded shape of the assembly consisting of the base portion 7, the upstanding partition portion 8 and the two containers 4 and 5 makes the carpet cleaning machine as shown easy to manoeure. The absence of the sharp corners further improves the safety of working with the machine, reducing the risk of personnel being bruised by violet contact with the machine.

If the containers are made from transparent or translucent material, such as polyethylene, the liquid level in each container may easily be observed from the outside, making it possible for the user to decide when to remove the containers for re-filling or emptying respectively.

Each container 4, 5 is supported by the machine housing 1 by means of two tubular plugs 11 on each side of the partition portion 8, said plugs 11 being directed obliquely upwards as best seen in FIG. 3. The plugs 11 are adapted to engage corresponding sockets 12 recessed in the upper part of the flat wall 10 on each container 4, 5, so that the container 4, 5 will be completely supported by the machine housing 1 or rather the partition portion 8, when the container in question has been placed in the space 14 above the base portion 7 with its sockets 12 in engagement with the plugs 11 on the partition portion 8.

When it is desired to have fluid communication between the components inside the machine housing 1 and the upper part of the internal space of a container 4 or 5, such as will normally be the case with the "dirty" container 5 receiving dirty liquid having been aspirated from the carpet through the suction tube 2, then this fluid communication is established by means of openings 13 in the bottom portion of each socket 12 in question. The use of two openings 13 makes it possible to let the aspirated air flow through the upper space in the "dirty" container 5 and leave dirty cleaning liquid to settle in the container, but it is also possible to separate the dirty liquid from the aspirated air outside of the container, such as in a suitable separate (not shown) placed somewhere in the machine housing 1, preferably in the upstanding partition portion 8.

When it is desired to have fluid communication between the components inside the machine housing 1 and the lower part of the internal space of a container 4 or 5, such as will normally be the case with the "clean" container 4 containing fresh cleaning liquid to be applied to the carpet being cleaned, then this fluid communication is established by means of a connector 15 placed on and protruding from the top of the base portion 7, vide FIG. 3, said connector 15 being adapted to cooperate with a connector-cum-valve (not shown) suitably placed in the bottom wall of the container 4, so that when the container 4 is placed in the space 14 in question and hooked onto the plugs 11, the connector 15 on the base portion 7 engages the connector-cum-valve in the bottom wall of the container 4 and opens the valve therein, so that fresh cleaning liquid may flow from the "clean" container 4 to the liquid supply (not shown) for delivery to the liquid ejection nozzle(s) (not shown) mentioned above. As the connector 15 protrudes above the top of the base portion 7, it will make its presence evident under any attempt to place the "dirty" container 5 in the space 14 allotted to the "clean" container 4, thus preventing any mistakes in this respect.

Apart from the presence or absence of the openings 13 and the connector-cum-valve (not shown) in the bottom wall of the "clean" container 4, the two containers 4 and 5 are essentially identical in shape, so that they may be produced, such as by blow moulding, using the same moulds, thus reducing production costs. Producing the containers 4 and 5 by blow moulding will usually make it necessary to have a more or less constant wall thickness in the whole container, for which reason it is advantageous to form the flat wall 10 with corrugations 16, so that it will resist deformation due to pressure or vacuum in the container to a degree comparable to that of the curved wall 17 of each container 4 or 5. Each container further has a carrying handle 18 and a closure 19 for a top opening (not shown), through which the container may be filled or emptied in the usual manner.

In the embodiment shown in the drawings, the base portion 7 comprises a motor housing 20 protruding centrally from the top of the base portion 7. To accommodate for this, each container 4 and 5 is shaped with a corresponding bottom recess 21, engaging the motor housing 20 and thus providing additional stability to the container when supported on the machine housing 1. An electric cord 22 with a plug 23 is used to connect the motor(s) in the machine to the mains or other source of electrical power.

When the apparatus is not being used, the tubes 2 and 3 may be coiled around the cylindrical assembly consisting of the containers 4 and 5 and the partition portion 8, the coiled tubes being kept in place by a spring-loaded supporting hook 24 secured to the side of the partition portion 8 opposite the side to which the tubes 2 and 3 are connected. The free ends of the tubes 2 and 3 may be placed in the recess formed between the two containers 4 and 5 on top of the partition portion 8, or inserted through the openings formed below the handles 18, 9 and 18 respectively.

I claim:

1. A machine for cleaning carpets and the like and comprising (a) a machine housing (1) containing at least a suction fan, a liquid pump and means for driving same, (b) a first container (4) for uncontaminated cleaning liquid removably supported by said machine housing (1), and (c) a second container (5) for cleaning liquid having been ejected into a carpet or the like and subsequently aspirated by said fan through said suction mouthpiece, said second container (5) also being removably supported by said machine housing (1), (d) flexible tubing (2, 3) allowing communication of said liquid pump with an ejection nozzle, and said fan with a suction mouthpiece, characterized in (e) that said machine housing (1) comprises a substantially horizontal base portion (7) with a partition portion (8) extending substantially vertically upwards therefrom in such a manner to leave a space (14) limited downwardly by a part of said base portion (7) and on one side by said partition portion (8) on each side of same, and (f) that said machine housing (1) is adapted to receive said first (4) and second (5) containers in said spaces (14) resting substantially close to said parts of said base portion (7) and substantially close to said partition portion (8).

2. A machine according to claim, 1 characterized in that said base (7) and partition (8) portions and said first (4) and second (5) containers have such cooperating shapes that the external shape of the machine with said first (4) and said (5) containers in place, is at least approximately that of a cylinder with a vertical axis.

3. A machine according to claim 1 or 2, characterized in (a) that at least one of said first (4) and second (5) containers in the upper part of its wall (10) adapted to face said partition portion (8) comprises at least one socket (12), the axis of which extends downwards and away from its inner end, and (b) that said partition portion (8) on at least one side adapted to face said container comprises at least one plug (11) adapted to cooperate with said socket

(12) to establish mechanical connection between the container and said machine housing (1), when said container is placed in the operating position in said space (14).

4. A machine according to claim 3, characterized in that said socket (12) comprises an opening (13) communicating with the interior of said second container, and that said cooperating plug (11) on said partition portion (8) is tubular and adapted to establish fluid communication between said second container and fluid conducting means in said partition portion (8), when said second container is placed in the operating position in said space (14).

5. A machine according to claim 3, characterized by a bottom valve in said first container (4) adapted to establish a connection between the interior of the container and a connector (15) communicating with said liquid pump, when the container is placed in the operating position in said space (14), said connector (15) extending upwards from the upper side of that part of said base portion (7) adapted to face the bottom part of said first container (4).

6. A machine according to claim 5, characterized in that the first (4) and the second (5) containers are identically shaped, with the exception of their fluid connection elements.

7. A first (4) or second (5) container for a machine according to claim 1 or 2, characterized in that is comprises a substantially flat inner wall (10) adapted to face said partition portion (8) on said machine housing (1) and a substantially semi-cylindrical outer wall (17) as well as a top wall and a bottom wall, all of said walls having substantially equal thickness, and said inner wall (10) being provided with corrugations (16) to increase its rigidity.

8. A container according to claim 7, characterized in that it is at least in part made from an at least translucent material of a kind to make is possible to observe the liquid level in the container visually.

* * * * *

UNITED STATES PATENT AND TRADEMARK OFFICE

CERTIFICATE OF CORRECTION

PATENT NO. : 4,724,573

DATED : February 16, 1988

INVENTOR(S) : Karsten Z. Ostergaard

It is certified that error appears in the above-identified patent and that said Letters Patent is hereby corrected as shown below:

| | |
|---|---|
| Column 1, line 29: | after "avoiding" delete "shape" and insert -- sharp --. |
| Column 6, line 8: | in claim 7, line 2, after "that" delete "is" and insert -- it --. |

Signed and Sealed this

Eighth Day of June, 1993

*Attest:*

*Attesting Officer*

Michael K. Kirk

MICHAEL K. KIRK

*Acting Commissioner of Patents and Trademarks*